US006794928B2

(12) United States Patent
Lei

(10) Patent No.: US 6,794,928 B2
(45) Date of Patent: Sep. 21, 2004

(54) LOW VOLTAGE CONSTANT CURRENT SOURCE

(75) Inventor: Chia-Cheng Lei, Hsintien (TW)

(73) Assignee: Samhop Microelectronics Corp., Hsintien (TW)

( * ) Notice: Subject to any disclaimer, the term of this patent is extended or adjusted under 35 U.S.C. 154(b) by 0 days.

(21) Appl. No.: 10/329,784

(22) Filed: Dec. 27, 2002

(65) Prior Publication Data

US 2004/0124908 A1 Jul. 1, 2004

(51) Int. Cl.[7] ..... G05F 1/10
(52) U.S. Cl. ..... 327/538
(58) Field of Search ..... 327/530, 534, 327/535, 538, 539, 540, 541, 542, 543

(56) References Cited

U.S. PATENT DOCUMENTS 5,805,015 A * 9/1998 Bruccoleri et al. ..... 327/538
6,337,596 B1 * 1/2002 Shimozono ..... 327/538

* cited by examiner

*Primary Examiner*—Jeffrey Zweizig
(74) *Attorney, Agent, or Firm*—Dellett & Walters

(57) ABSTRACT

A low voltage constant current source is composed of a reference current circuit being insensitive to temperature variation, and multiple current output units in response to the reference current circuit to individually output a stable current. Each current output unit is individually controlled to be activated or not, and each output current is amplified in any desired ratio to a reference current generated by the reference current circuit. Moreover, since each current unit is operated independently, the interference among each other is avoided when each output unit is applied in the open-collector.

18 Claims, 8 Drawing Sheets

LOW VOLTAGE CONSTANT CURRENT SOURCE

BACKGROUND OF THE INVENTION

1. Field of the Invention

The invention is related to a low voltage constant current source with a reference current source and multiple current output units, and more particularly, each output current is individually amplified by a desired ratio to the reference current, and is independent from other output units to avoid any interference.

2. Description of Related Arts

With reference to FIGS. 1A and 1B, two different types of conventional current mirrors composed of bipolar transistors (BJTs) are respectively shown, wherein NPN transistors constitute the current mirror shown in FIG. 1A, and PNP transistors constitute that of FIG. 1B. Basically, the circuit operations of the two current mirrors are similar. As shown in FIGS. 1A and 1B, because the bases of the two NPN transistors are connected together and emitters are both connected to ground, the junction voltage $V_{BE1}$ and $V_{BE2}$ are equal. In a condition that the two NPN transistors of FIG. 1A (or the PNP transistors in FIG. 1B) are matched, the input current $I_1$ (reference current) is approximately equal to the output current $I_2$, wherein a partial current (designated with $I_B$) of the input current $I_1$ is used to bias the two transistors. An approximate relationship between the two currents $I_1$ and $I_2$ is:

$$I_2=I_1\times\beta/(\beta+2)$$

where β is called forward current gain, and the definition of which is $\beta=I_C/I_B$.

The typical value of β approximately lies between tens and hundreds, such as 50–250, and is varied with the size, the operating temperature or other manufacturing factors of the transistor. Obviously, the relationship between the input current $I_1$ and the output current $I_2$ is varied with β. When β value is getting smaller, $I_B$ is getting larger and the difference between $I_1$ and $I_2$ is accordingly increased.

For the current mirrors shown in FIGS. 1A and 1B, because the consumption of the input current $I_1$ is large, such a current mirror is unsuitable to configure a multi-stage current mirror.

If the ratio between the transistors in FIG. 1A or 1B are not 1:1 but 1:N, the effect of current amplification is obtained, where the output current $I_2$ is expressed the equation $I2\approx N\times I_1$. The precise equation is $I_2=I_1\times\beta N/(\beta+1+N)$. Therefore, when the value of N is getting closer to β, the current amplifying ratio $\beta N/(\beta+1+N)$ is rapidly reduced. Such unmatched transistors will cause an extreme restriction on the current amplification of a current mirror. Moreover, limited by the manufacturing process of the bipolar transistors, the current mirror composed of bipolar transistors is only capable of providing an integer current amplification ratio, for example, 1:5, 2:3 or 10:7.

With reference to FIGS. 2A and 2B, two current mirrors composed of CMOS transistor are respectively illustrated, wherein NMOS transistors constitute the current mirror of FIG. 2A and PMOS transistors are for FIG. 2B. The operation of the CMOS current mirror is similar to the BJTs as mentioned above. When the two NMOS transistors (or PMOS) are matched, i.e. the channel width (W) and channel length (L) ratio (W/L) of the two NMOS transistors are identical, since the junction voltages between gate and source of the two NMOS transistors are the same ($V_{GS1}=V_{GS2}$) and there is almost no current flowing into the gates of the NMOS transistors ($I_G\approx 0$), the input current $I_1$ is approximately equal to the output current $I_2$. The error between the input and the output current is caused from that the output current $I_2$ is influenced by the output voltage $V_{DS2}$. Thus, when $V_{DS2}$ is not equal to $V_{GS2}$, a minor difference between $I_1$ and $I_2$ arises.

Since the channel width/length ratio (W/L) of the CMOS elements is programmable by properly controlling the design thereof, the non-integer current amplification ratio ($I_2/I_1$) is easily achieved by the CMOS current mirror. Furthermore, since the influence on the output current $I_2$ caused from the gate current is tiny, the CMOS current mirror is capable of providing a large current amplification ratio. However, the application of CMOS transistors is still limited by several factors, such as the low current driving ability, low transconductance ($g_m$), low voltage endurance etc. Thus, when the CMOS current mirror is required to provide a high output current and a high voltage endurance, the CMOS transistors are usually manufactured to have a larger size than the BJT transistors, so the production cost is accordingly increased.

With reference to FIGS. 3A and 3B, two current mirrors with gain are respectively composed of NPN BJTs and PNP BJTs. Each current mirror further contains a gain transistor to provide a base current $I_B$. The relationship between the input current $I_1$ and the output current $I_2$ is expressed by equation $I_2=I_1\times(\beta^2+\beta)/(\beta^2+\beta+2)$. Obviously, since the numerator and denominator of the equation both have $\beta^2$, the constant 2 in the denominator is able to be omitted from the equation. The output current $I_2$ then is independent from β and almost equal to the input current $I_1$.

However, the current mirrors shown in FIGS. 3A and 3B still have some problems in some particular operating conditions. For example, if the output of the current mirror is connected with a load and the output transistor is operated in the forward active region, the current mirror still functions normally. However, if the output of the current mirror is floating (i.e. there is no load connected to the output) or the output transistor is operated in the saturation region, a large current will flow through the gain transistor to the output transistor. Such a large current has some additional problems, such as power consumption and heat generation. Moreover, each transistor with base connected to the gain transistor is influenced and the output current is greatly decreased.

With reference to FIGS. 4A and 4B, a NMOS transistor (or a PMOS transistor in FIG. 4B) is applied to replace the BJT gain transistors as shown in FIGS. 3A and 3B. Since the gate current of the NMOS transistor is almost zero, the input current $I_1$ is independent. The base current for the two BJT transistors is completely supplied by the NMOS transistor (or the PMOS transistor). The advantage of such current mirrors is that the output current is independent of the β and operating temperature. Thus, if the current driving ability of the NMOS transistors is large enough, the current gain is able to be greatly increased.

However, the current mirrors shown in FIGS. 4A and 4B also suffer from the problems as mentioned of FIGS. 3A and 3B. When the output of the current mirror is floating, i.e. there is no load connected to the output, or the output transistor is operated in the saturation region, a large current will flow through the gain transistor to the output transistor.

Whether in FIGS. 3A and 3B or FIGS. 4A and 4B, since a gain transistor is additionally provided in the current mirror, an additional voltage is needed to bias the gain transistor. For example, the bias voltage for the current mirror in FIG. 3A is required to have $V_{BE}+V_{BE}$, and FIG. 4B requires $V_{BE}+V_{GS}$. Due to the additional bias voltage, the current mirror is unsuitable to be worked in the low operating voltage.

With reference to FIG. 5, a current mirror with multi current output units is mainly composed of BJTs and switching elements. Each switching element can be chosen from NMOS, PMOS or CMOS transmission gates. All the transmission gates must be identical and operated at the same bias voltage to ensure that each output unit is worked correctly. The transmission gate (the first one from the left) is always kept at conductive. Each output unit is equipped with a transmission gate, whereby each output current is independently determined by its own transmission gate.

If the possible floating problem occurring at each output unit is predictable or detectable, each transmission gate can be individually controlled to be opened or closed. Actually, even when there is no control circuit for controlling the open/close of each transmission gate, each transmission gate itself is still capable of restricting unusually large current, so each output unit is independent and will not influence each other.

If the amplification ratio is intended to be higher than one, each transmission gate and each output transistor must be simultaneously changed. For example, if the intended amplification ratio is 3, the size (W/L) of the transmission gate and the output transistor both must be increased to be three times greater than their original size. Thereby, each voltage level $V_{TG}$ across each transmission gate is the same.

However, since the base current $I_B$ is completely depended on the input current $I_1$, the output current of the current mirror shown in FIG. 5 is easily interfered with by β. To solve the problem, the gain transistors as shown in FIGS. 3 and 4 or the known Darlington Pair transistors can be employed. Moreover, since each transmission gate requires an operating voltage $V_{TG}$, the current mirror is unsuitable to be worked in the low operating voltage.

With reference to FIG. 6, another conventional constant current source circuit mainly comprises two parts, a constant reference current circuit and a current mirror circuit, both respectively illustrated at the left and right sides and separated by the dotted line. The total amount of the current mirrors at the right side is usually designed to have 8 bits or 16 bits. The reference constant current source circuit consists of a band-gap voltage generator and a PMOS current mirror (all MOS elements are replaceable by corresponding BJT elements). Therefore, the influence on the reference current circuit caused by temperature variation is very small, i.e. the generated reference current is insensitive to the temperature. However, because the current mirror circuit employs an NPN gain transistor to provide base currents for all output transistors, the current mirror becomes very sensitive to the operating temperature. To solve this problem, the NPN gain transistor is replaced with an NMOS gain transistor or the Darlington Pair transistors.

Further, the circuit of FIG. 6 is difficult to be operated at the low voltage. For example, the total voltage value to activate the current mirror is $V_{DSR}+V_{BEG}+V_{TG}+V_{BER}$ (as designated in FIG. 6). So if the circuit were intended to be operated at a low voltage lower than 3.3 volts, that would be a great challenge. Another problem of the circuit in FIG. 6 is that each output current ($I_1$–$I_N$) is easily interfered with by the activation of other transmission gates. The reason of said interference is that the bias voltage $V_{BEG}$ of the gain transistor is varied with the total base currents provided by the gain transistor itself. If the MOS transistor is employed as the gain transistor, the variation is more serious. Besides the varied bias voltage $V_{BEG}$, the voltage $V_{DSR}$ is also affected. Therefore, each output current value ($I_1$–$I_N$) would be in inverse proportion to the total activated output transistors.

To overcome the problems of the conventional circuit of FIG. 6, the voltage $V_{DSR}$ must be kept at a constant value and independent of the output currents ($I_1$–$I_N$). Further, the voltages $V_{BEG}$ and $V_{TG}$ must be reduced, and the reference current $I_R$ should also be independent of the output currents ($I_1$–$I_N$), that means the reference current $I_R$ must be independent of the base current $I_B$.

To overcome the mentioned shortcomings, a low voltage constant current source operated at a low voltage in accordance with the present invention obviates or mitigates the aforementioned problems.

SUMMARY OF THE INVENTION

The main objective of the present invention is to provide a low voltage constant current source with a reference current source and multiple current output units to respectively provide a reference current and multiple individual output currents. Each output current is individually amplified by a desired ratio to the reference current, and is independent from other output units to avoid any interference.

To achieve the objective, the low voltage constant current source comprises:

a reference current source;

multiple current output units;

a control circuit coupled between the reference current source and the multiple output units, wherein the control circuit at least includes an operational amplifier, a transistor and a transmission gate;

wherein the operational amplifier is used for comparing an output voltage $V_{CER}$ of the reference current source with a reference voltage, and based on the compared result to determine bias voltages of the reference current source and each current output unit.

The features and structure of the present invention will be more clearly understood when taken in conjunction with the accompanying figures.

DETAILED DESCRIPTION OF THE PREFERRED EMBODIMENT

Figure 7A:
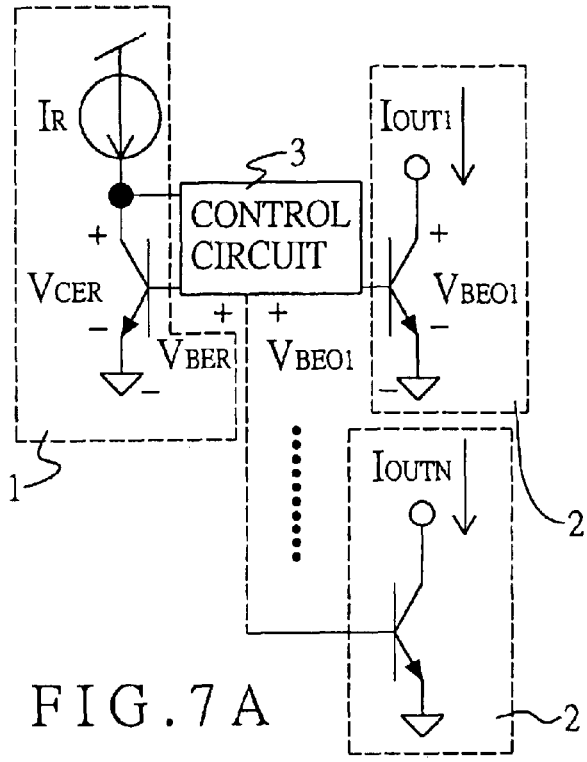
FIGS. 7A and 7B show two current mirrors composed of NPN BJTs and PNP BJTs in accordance with the present invention.
Figure 7B:
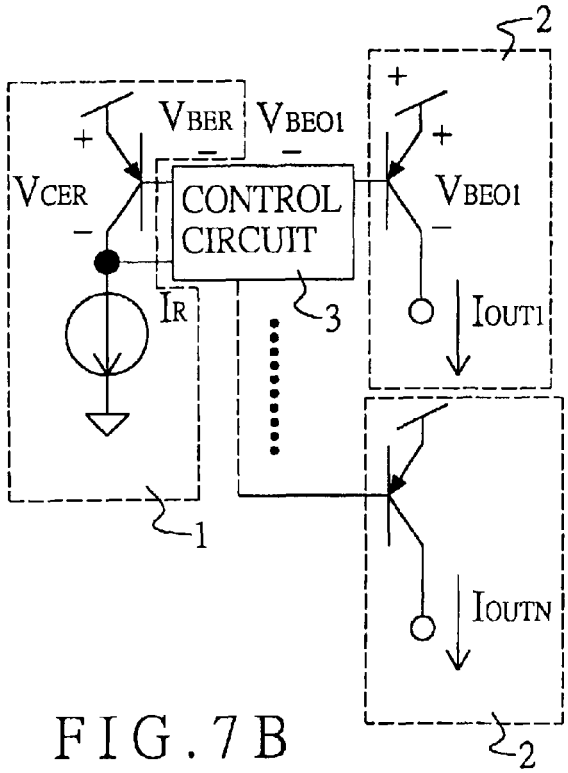

With reference to FIGS. 7A and 7B, two constant current sources in accordance with the present invention are respectively composed of NPN BJTs and PNP BJTs. The current source of FIG. 7A is also known as a sink-type current source, and FIG. 7B is also called the source-type current source. Each current source comprises a reference current circuit (1), multiple current output units (2) and a control circuit (3) coupled therebetween. A transistor (not numbered) disposed in the reference current circuit (1) is called the input transistor hereinafter, and transistors in each current output units (2) are output transistors.

Figure 8A:
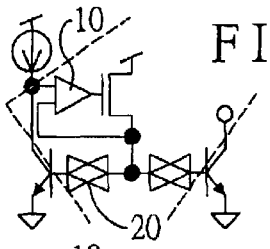
FIGS. 8A–8L show multiple embodiments of a control circuit in accordance with the present invention.

With reference to FIG. 8A, a first embodiment of the control circuit (3) includes an operational amplifier (10), a transistor, a transmission gate (20). The operational amplifier (10) compares an output voltage ($V_{CER}$, designated in FIGS. 7A and 7B) of the reference current circuit (1) with an internal voltage inside the control circuit (3) or an external voltage from an external circuit (not shown). Based on the compared result, bias voltages for the input transistor ($V_{BER}$) of the reference current circuit (1) and for each output transistor ($V_{BEO}$) are determined. Further, the transmission gate (20) not only determines the activation of the output transistor, but also eliminates problems of power consumption and interference when the current output unit is operated in the open-collector. Thus, the control circuit is suitably operated with a low voltage, and the additional biasing voltage for conventional bipolar or MOS transistors is not needed. Moreover, the output voltage ($V_{CER}$) of the reference current circuit (1) is not affected by the output currents. In addition, the reference current $I_R$ is not influenced by the operational amplifier, whereby the problems of the conventional BJT current source are completely overcome. The amount of the output units (2) is extendable from 1 to N, and each generated output current is in response to the same reference current $I_R$. Thereby errors among these output units (2) are greatly eliminated.

In FIGS. 8A to 8L, the control circuit (3) with different configurations are respectively shown. Each of the two configurations comprises the operational amplifier (10) with two input terminals, the transistor (MOS or Bipolar) and a transmission gate (20). The first input terminal of the operational amplifier (10) is connected to the reference current circuit (1), i.e. the collector of the NPN transistor, and the second input terminal is connected in different ways as shown in FIGS. 8A–8L.

Figure 8B:
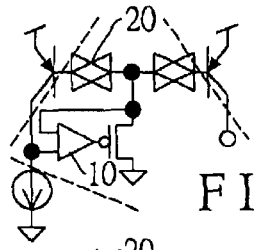

With reference to FIGS. 8A and 8B, the second terminal of the operational amplifier (10) is connected to a source of the MOS transistor. Thereby, the voltage at source is equal to the output voltage $V_{CER}$ of the reference current circuit (1). By such a configuration, the entire current source possesses the advantage provided by the MOS transistor, and would not need an additional threshold voltage.

Figure 8C:
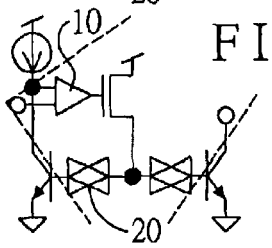
Figure 8D:
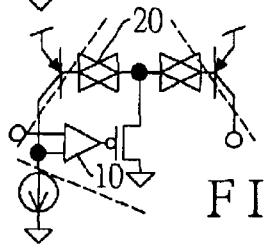

In FIGS. 8C and 8D, the second terminal of the operational amplifier is for connection to an external constant voltage (not shown). The external voltage is adjustable to meet any requirements of all kinds of circuits. Of course, the external voltage must be prevented from being excessively high or low, and other external factors.

Figure 8E:
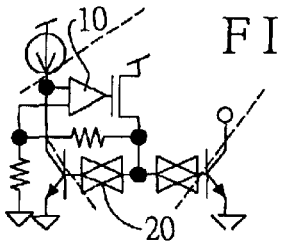
Figure 8F:
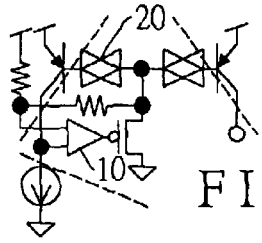

In FIGS. 8E and 8F, the operational amplifier (10) together with a resistor is configured to a non-inverse amplifier to control the MOS transistor. Thus, the output voltage ($V_{CER}$) of the reference current circuit (1) is smaller than the voltage at source of the MOS transistor. The amplification ratio of the non-inverse amplifier is adjustable, wherein the amplification ratio and the operating voltage are in the inverse proportion. Further, it must be noted whether the transistor is operated in saturation region, and whether the operational amplifier (10) is worked in the common mode normally.

Figure 1A:
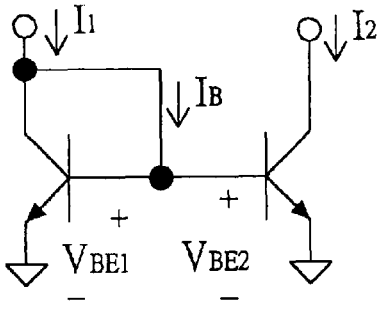
FIG. 1A PRIOR ART
FIGS. 1A and 1B respectively show conventional current mirrors composed of NPN BJTs and PNP BJTs.
Figure 1B:
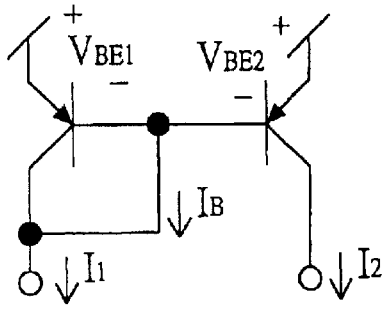
FIG. 1B PRIOR ART
Figure 2A:
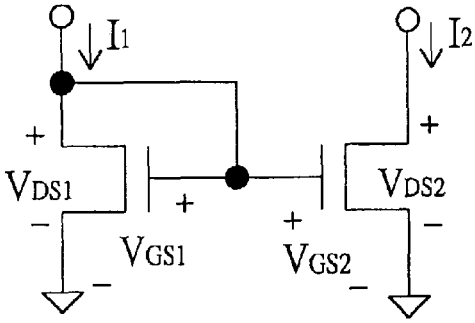
FIG. 2A PRIOR ART
FIGS. 2A and 2B respectively show conventional current mirrors composed of NMOS transistors and PMOS transistors.
Figure 2B:
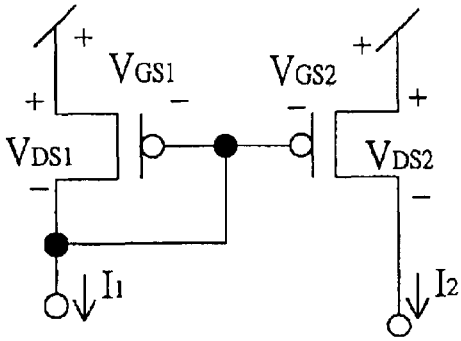
FIG. 2B PRIOR ART
Figure 3A:
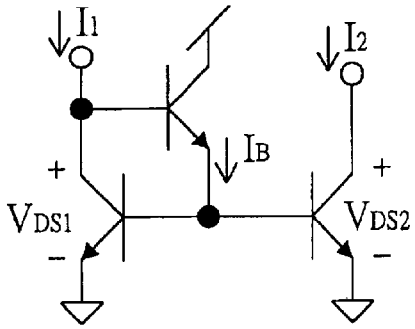
FIG. 3A PRIOR ART
FIGS. 3A and 3B show two conventional current mirrors with gain, wherein a NPN transistors and a PNP transistor are respectively adopted as a gain transistor in FIGS. 3A and 3B.
Figure 3B:
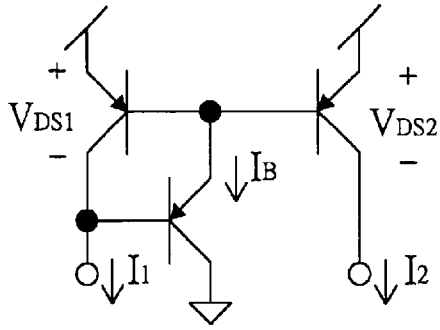
FIG. 3B PRIOR ART
Figure 4A:
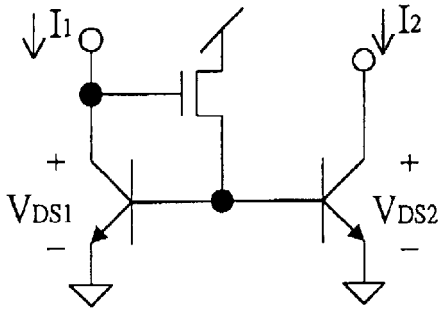
FIG. 4A PRIOR ART
FIGS. 4A and 4B show two conventional current mirrors with gain, wherein an NMOS transistor and a PMOS transistor are respectively adopted as a gain transistor in FIGS. 4A and 4B.
Figure 4B:
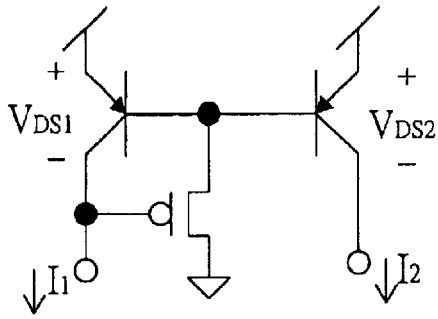
FIG. 4B PRIOR ART
Figure 5:
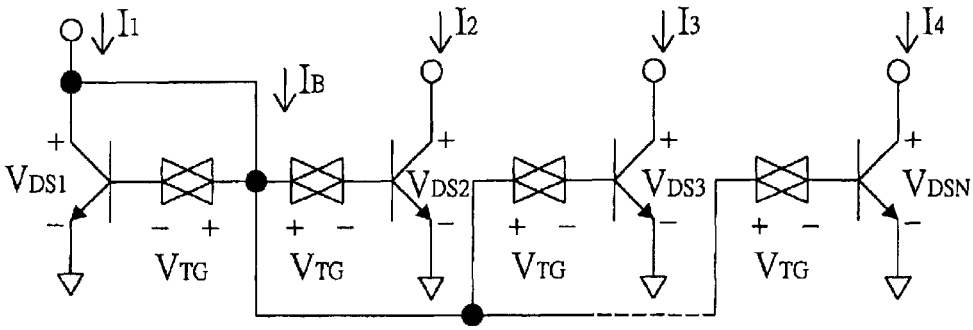
FIG. 5 PRIOR ART
FIG. 5 is a conventional current mirror having switching elements.
Figure 8G:
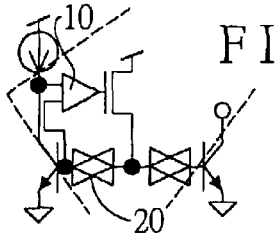
Figure 8H:
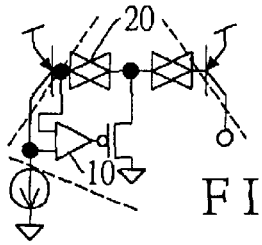

In FIGS. 8G and 8H, the base and the collector of the NPN transistor in the reference current circuit (1) are constructed to have a virtual short-circuit by the operational amplifier (10). Therefore, the output voltage level ($V_{CER}$) of the reference current circuit (1) is equal to the voltage level at base of the NPN transistor. The effect of the virtual short-circuit is the same as the conventional current mirror as shown in FIGS. 1A and 1B, where the base and the collector are physically connected together.

Figure 8I:
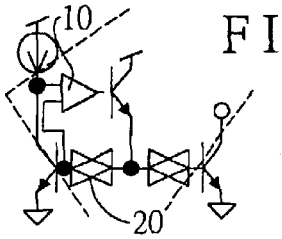
Figure 8J:
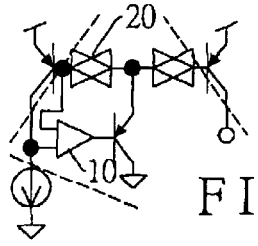

With reference to FIGS. 8I and 8J, the NMOS (or PMOS) transistor shown in FIGS. 8G and 8H are replaced by the NPN (or PNP) transistor. Actually, all NMOS (or PMOS) transistors shown in FIGS. 8A to 8F are replaceable by the NPN (or PNP) transistor.

Figure 8K:
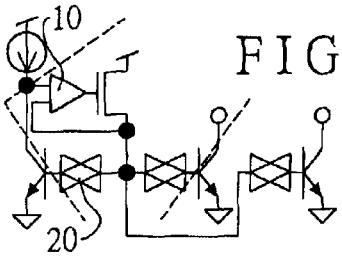
Figure 8L:
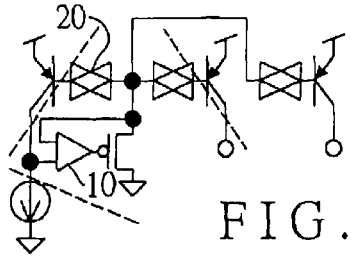

With reference to FIGS. 8K and 8L, the two embodiments are modified to have multi-stage output units based on the configurations of FIGS. 8A and 8B so as to show the expansion of the invention.

Figure 6:
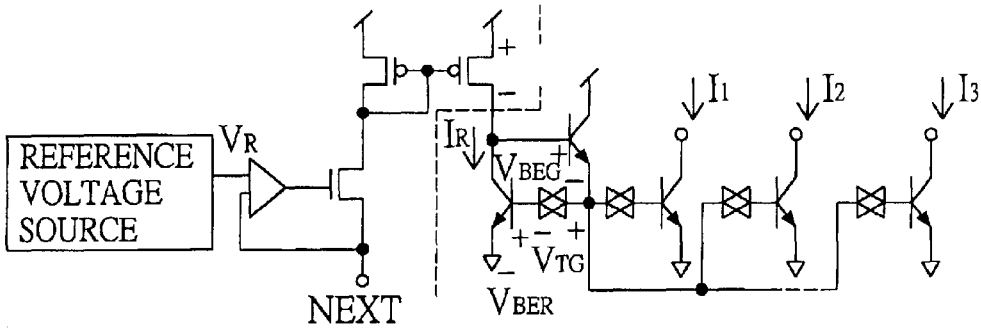
FIG. 6 PRIOR ART
FIG. 6 is a conventional constant current source circuit.
Figure 9:
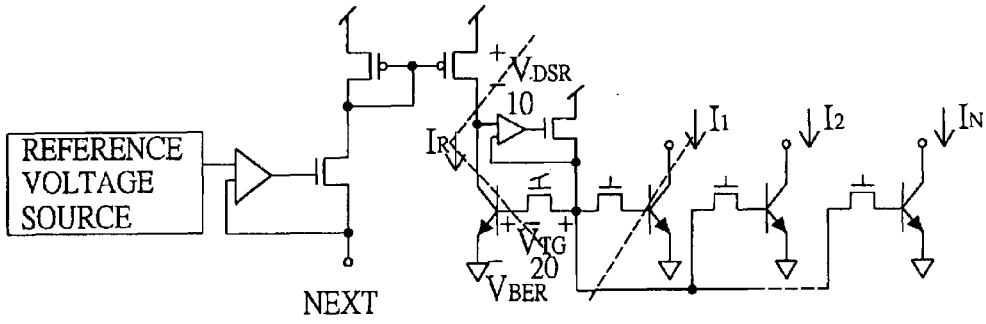
FIG. 9 shows a constant current source of the present invention.

With reference to FIG. 9, the circuit of FIG. 8A is applied to the current source shown in FIG. 6. By such a combination, all the shortcomings of FIG. 6 discussed foregoing are overcome. In the combination, the bias voltage for the gain transistor is completely unnecessary, wherein only the input offset voltage for the operational amplifier (10) is needed and the voltage $V_{DSR}$ becomes a constant value. Since the operational amplifier does not need the input bias current from the reference current $I_R$, the reference current $I_R$ is completely independent and would not be influenced. The current driving ability of the operational amplifier (10) and each transistor is able to be individually adjusted so as to meet different current output requirements when the current source has different output bits (such as 8 bits or 16 bits). In FIG. 9, each transmission gate (20) is implemented only by the NMOS transistor to simplify the entire circuit structure, without needing to employ the NMOS and PMOS transistors collectively. Each NMOS transistor is not only utilized as a switching element for each current output unit, but also provided to limit the large current when the output terminal is floating and to prevent any interference among other current units.

Figure 10:
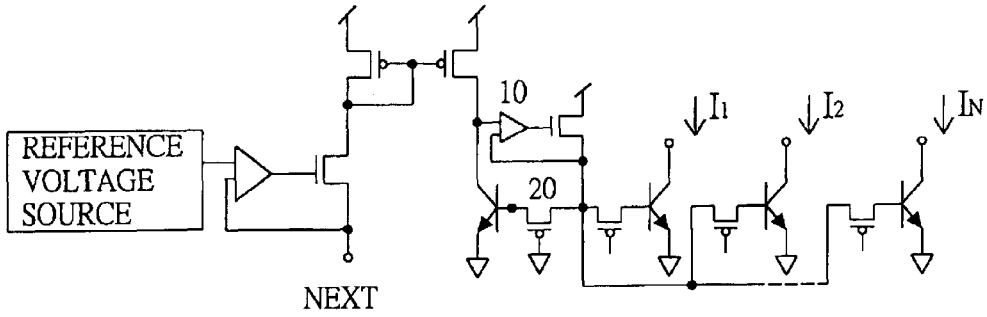
FIG. 10 shows a constant current source of the present invention, wherein PMOS transistors are provided to replace the NMOS transistors of FIG. 9.

With reference to FIG. 10, the PMOS transistor is used as the transmission gate (20), whereby the large current problem caused from the floating at the output terminal is eliminated. Moreover, the operating voltage range of FIG. 10 is wider than that of FIG. 9.

In FIG. 9, the gate of the NMOS transmission gate (20) is connected to a power voltage. Therefore, when the voltage level of the power voltage experiences any variation, the equal impedance of the NMOS transmission gate (20) and the voltage $V_{TG}$ across on the transmission gate (20) are accordingly varied. For example, if the power voltage is decreased, the voltage $V_{TG}$ across on the NMOS transmission gate (20) would be contrarily increased, and therefore the current source is unsuitable to be applied in the low operating voltage.

On the contrary, if the transmission gate (20) is constructed from the PMOS transistor as shown in FIG. 10, because the gate of the PMOS transistor is connected to ground—a steady voltage level, the equal impedance of the PMOS transistor is stable. The voltage ($V_{TG}$) of the PMOS transistor is also retained at a stable value. Thus, the operating voltage range of the current source is accordingly widened.

Figure 11:
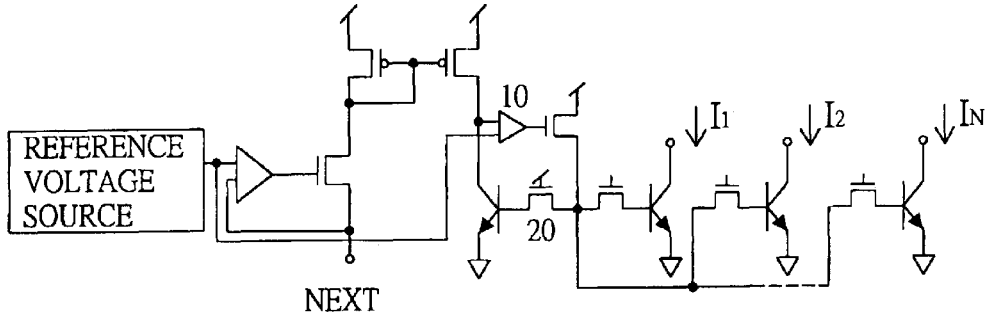
FIGS. 11–16 show different embodiments of the constant current source in accordance with the present invention.
Figure 12:
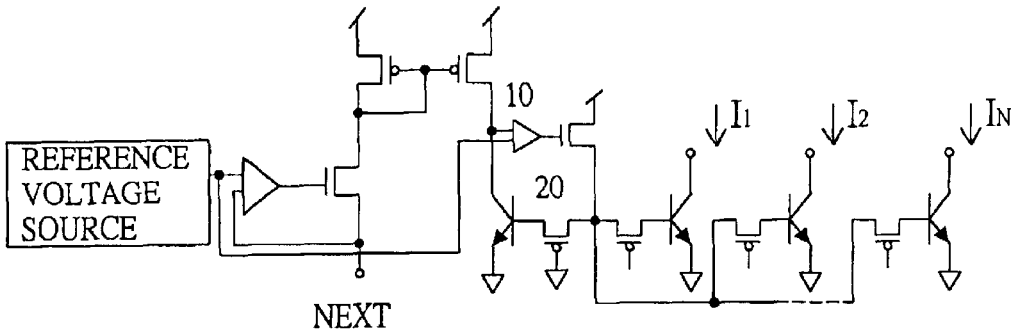

With reference to FIGS. 11 and 12, the circuit of FIG. 8C is employed. The second terminal of the operational amplifier (10) is connected to a reference voltage source. If the reference voltage source is constructed by a band-gap voltage generator, the provided reference voltage at the second terminal is approximately equal to 1.25 volts and is not affected by temperature variation. Such a configuration makes the voltage $V_{DSR}$ to be very stable.

Figure 13:
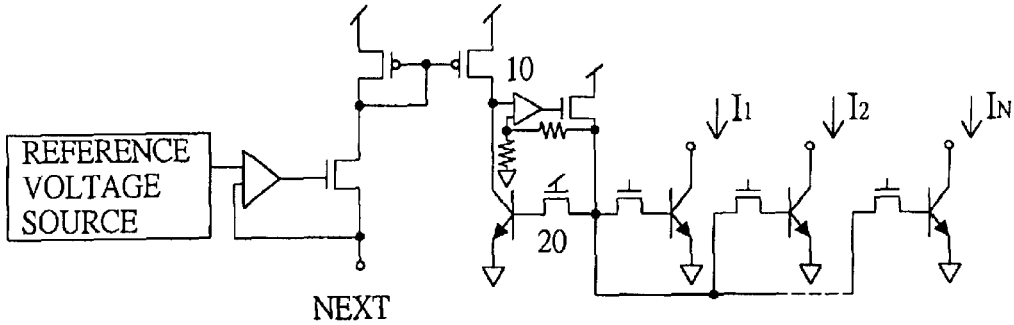
Figure 14:
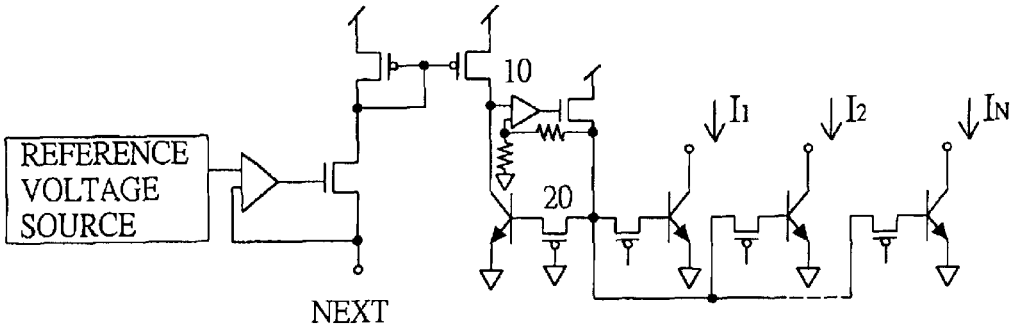
Figure 15:
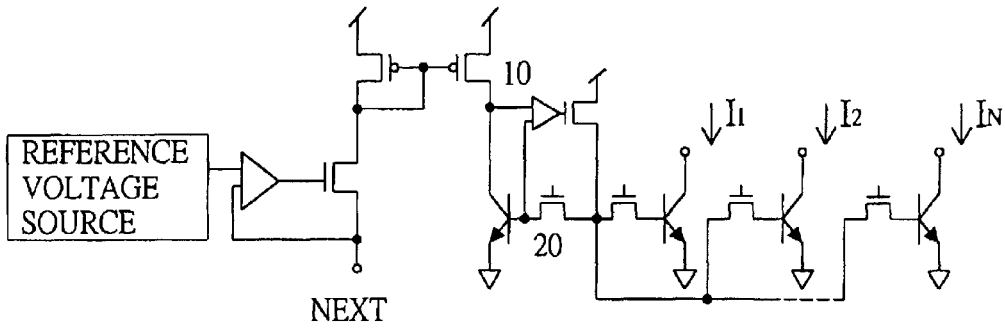
Figure 16:
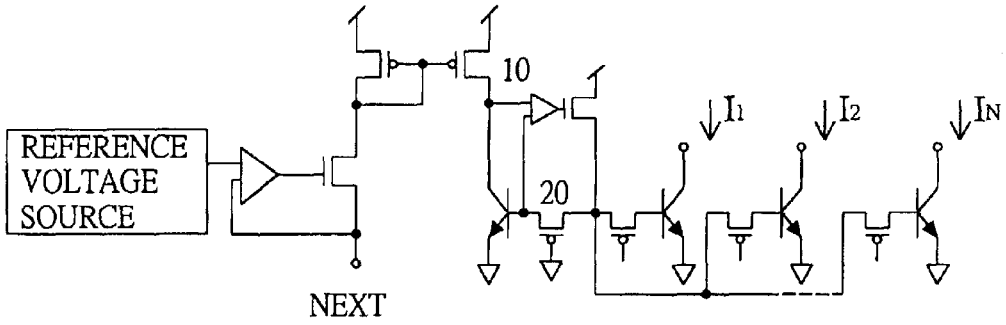

With reference to FIGS. 13 and 14, the circuit of FIG. 8E is applied in the constant current source, wherein as long as the operational amplifier (10) and the NPN transistor are operated in the correct region, the amplification ratio of the non-inverse amplifier is adjustable. In FIGS. 15 and 16, the circuit of FIG. 8G is employed to form the current source. The collector and the base of the NPN transistor are configured to have the virtual short-circuit. The voltage at the collector (or base) is approximately 0.7V whereas the operating voltage range is very broad as long as the operational amplifier (10) is correctly worked in the common mode range.

From the foregoing descriptions of the different embodiments, the current source is operated with a low voltage by the use of the control circuits as shown in FIGS. 8A–8L. Further, the bias voltage for bipolar transistor or MOS transistor in the conventional current source is greatly reduced or even eliminated. The output voltage $V_{CER}$ of the reference current circuit (1) would not be interfered with by the output currents. The interference for the reference current generated by the reference current circuit (1) is also prevented from the operational amplifier (10).

The foregoing description of the preferred embodiments of the present invention is intended to be illustrative only and, under no circumstances, should the scope of the present invention be restricted by the description of the specific embodiment.

What is claimed is:

1. A low voltage constant current source, comprising:

a reference current circuit;

multiple current output units; and a control circuit coupled between the reference current circuit and the multiple output units to compare an output voltage of the reference current circuit with a reference voltage, wherein the control circuit based on the compared result determines bias voltages and bias currents of the reference current circuit and each current output unit;

wherein the control circuit comprises an operational amplifier having a first input terminal and a second input terminal, a transistor and a transmission gate wherein the first input terminal of the operational amplifier is connected to the reference current circuit to obtain the output voltage.

2. The constant current source as claimed in claim 1, wherein the transistor of the controls is an MOS transistor, and the second input terminal of the operational amplifier is connected to a source of the MOS transistor, whereby a voltage level at the source of the MOS transistor is equal to the output voltage of the reference current circuit.

3. The constant current source as claimed in claim 1, wherein the second input terminal of the operational amplifier is adapted to connect to an external circuit to obtain an adjustable external voltage.

4. The constant current source as claimed in claim 1, wherein the operational amplifier is configured as a non-inverse amplifier to control the transistor of the control circuit.

5. The constant current source as claimed in claim 1, wherein the reference current circuit further comprises a bipolar transistor, wherein the first input terminal and the second input terminal of the operational amplifier are respectively connected to a base and a collector of the bipolar transistor to construct a virtual short-circuit between the base and the collector of the bipolar transistor.

6. The constant current source as claimed in claim 1, wherein the transistor of the control circuit is chosen from an NMOS transistor or a PMOS transistor.

7. The constant current source as claimed in claim 2, wherein the transistor of the control circuit is chosen from an NMOS transistor or a PMOS transistor.

8. The constant current source as claimed in claim 3, wherein the transistor of the control circuit is chosen from an NMOS transistor or a PMOS transistor.

9. The constant current source as claimed in claim 4, wherein the transistor of the control circuit is chosen from an NMOS transistor or a PMOS transistor.

10. The constant current source as claimed in claim 1, wherein the transistor of the control circuit is a bipolar transistor.

11. The constant current source as claimed in claim 3, wherein the transistor of the control circuit is a bipolar transistor.

12. The constant current source as claimed in claim 4, wherein the transistor of the control circuit is a bipolar transistor.

13. The constant current source as claimed in claim 1, wherein the reference current circuit is composed of a band-gap voltage generator and a PMOS current mirror, and the each of the multiple output current units comprises an NPN transistor with a base that is connected to the reference current circuit through a transmission gate.

14. The constant current source as claimed in claim 13, wherein the transmission gate is an NMOS transistor.

15. The constant current source as claimed in claim 13, wherein the transmission gate is a PMOS transistor.

16. The constant current source as claimed in claim 13, wherein the control circuit comprises an operational amplifier with two input terminals, wherein one input terminal of the operational amplifier is connected to the band-gap voltage generator.

17. The constant current source as claimed in claim 13, wherein the control circuit comprises an operational amplifier that is configured as a non-inverse amplifier.

18. The constant current source as claimed in claim 13, wherein the PMOS current source further comprises an NPN transistor with a base and a collector, wherein the base and the collector of the NPN transistor are configured as a virtual short-circuit.

* * * * *